US007692589B2

(12) United States Patent
Kurashima et al.

(10) Patent No.: US 7,692,589 B2
(45) Date of Patent: Apr. 6, 2010

(54) ANTENNA DEVICE, ELECTRONIC DEVICE, AND METHOD OF MANUFACTURING ANTENNA DEVICE

(75) Inventors: Shigemi Kurashima, Shinagawa (JP); Hideki Iwata, Shinagawa (JP); Masahiro Yanagi, Shinagawa (JP); Takashi Yuba, Shinagawa (JP); Takashi Arita, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 331 days.

(21) Appl. No.: 11/819,483

(22) Filed: Jun. 27, 2007

(65) Prior Publication Data

US 2008/0169983 A1 Jul. 17, 2008

(30) Foreign Application Priority Data

Jan. 15, 2007 (JP) ..... 2007-006198

(51) Int. Cl.
*H01Q 1/38* (2006.01)

(52) U.S. Cl. ..... 343/700 MS; 343/846

(58) Field of Classification Search ..... 343/700, 343/702, 846, 829
See application file for complete search history.

(56) References Cited

U.S. PATENT DOCUMENTS 5,155,493 A * 10/1992 Thursby et al. ..... 343/700 MS
7,427,919 B2 * 9/2008 Baba et al. ..... 340/572.7

FOREIGN PATENT DOCUMENTS

| | | |
|---|---|---|
| JP | 2503512 | 4/1996 |
| JP | 2000-196327 | 7/2000 |
| JP | 2003-258520 | 9/2003 |

* cited by examiner

*Primary Examiner*—Tho G Phan
(74) *Attorney, Agent, or Firm*—Staas & Halsey LLP

(57) ABSTRACT

An antenna device is disclosed that includes: an element member; a ground member; and an adhesive through which the element member and the ground member are held in a predetermined positional relationship and affixed to a mounting object.

7 Claims, 8 Drawing Sheets

(A)

(B)

PRIOR ART

ANTENNA DEVICE, ELECTRONIC DEVICE, AND METHOD OF MANUFACTURING ANTENNA DEVICE

BACKGROUND OF THE INVENTION

1. Field of the Invention

The present invention relates generally to antenna devices, electronic devices, and methods of manufacturing antenna devices and, in particular, to an antenna device having an element member and a ground member, an electronic device, and a method of manufacturing an antenna device.

2. Description of the Related Art

In recent years and continuing to the present, much attention has been paid to wireless communications technologies using UWB (Ultra-WideBand) because they can provide radar positioning information and communications with large transmission capacity. The use of UWB within a frequency band from 3.1 to 10.6 GHz has been approved by the FCC (Federal Communications Commission) of the United States since 2002.

UWB refers to a communications method for communicating pulse signals over an ultra-wideband frequency range. Therefore, antennas for use in UWB require a structure capable of sending and receiving over the ultra-wideband frequency range.

As an antenna to be used within a frequency band from 3.1 to 10.6 GHz approved by the FCC, there is proposed at least one composed of a bottom board and a power supply body (Non-Patent Document 1).

FIGS. 1A and 1B show typical antenna devices. The antenna device 10 as shown in FIG. 1A has the bottom board 11 and the inverted conical-shaped power supply body 12 disposed thereon. The cone constituting the power supply body 12 is mounted in such a manner that its outside surface forms an angle θ with respect to the axis line. With this angle θ, a desired characteristic can be obtained.

The antenna device 20 as shown in FIG. 1B has the bottom board 11 and a teardrop-shaped power supply body 22 disposed thereon, the teardrop-shaped power supply body 22 being composed of a conical body 22*a* and an inscribed spherical body 22*b*.

Since typical ultra-wideband antenna devices have a flat-plate-shaped bottom board mounting a conical-shaped or a teardrop-shaped power supply body, they are large in size. Therefore, it is desired that they be miniaturized and made thin.

Note that there has been proposed a reverse F-shaped antenna device formed by punching a conductive tape as a thin antenna device (see, e.g., Patent Document 2).

In addition, there has been proposed a repeater antenna device having a structure in which a metallic tape wire circuit is affixed to an adhesive film to make the repeater antenna thin (see, e.g., Patent Document 3).

[Non Patent Document 1] "An Omnidirectional and Low-VSWR Antenna for the FCC-Approved UWB Frequency Band (B-1-1333)" of Proceedings of the IEICE General Conference in 2003, written by Takuya Taniguchi and Takehiko Kobayashi of Tokyo Denki University (presented at room 201 on March 22)

[Patent Document 1] JP-A-2000-196327

[Patent Document 2] JP-A-2003-258520

[Patent Document 3] Japan Utility Model Registration No. 2503512

Since typical ultra-wideband antenna devices have a flat-plate-shaped bottom board and a conical-shaped or a teardrop-shaped power supply body disposed thereon, they are large in size and cannot easily be mounted on electronic devices or the like. Therefore, it is desired that they be miniaturized and made thin just as the loop antennas, etc., are.

The structure that is desired in this case is one that permits the ultra-wideband antenna device of Patent Document 1 to be affixed directly to a casing or the like by making it thin and flexible. In this particular case, an element member and a ground member are arranged separated from each other in the ultra-wideband antenna device. Furthermore, the frequency characteristics and directivity of the antenna vary greatly depending on the positional relationship between the element member and the ground member. If an ultra-wideband antenna device is configured to allow a conductive tape, an adhesive tape, or the like to be processed by punching in the same manner as Patent Documents 2 and 3, the element member and the ground member would come apart into pieces. Therefore, it becomes impossible to hold the positional relationship between the element member and the ground member. Consequently, this configuration cannot easily be employed.

Accordingly, the present applicant proposes the UWB flat antenna device 30 as shown in FIGS. 2A and 2B in JP-A-2006-91602. The UWB flat antenna device 30 has a dielectric base 31. On the upper surface 31*a* of the dielectric base 31, there are arranged an antenna element pattern 32, a strip line 33, and two ground patterns 34 and 35. Furthermore, a coaxial connector 50 is mounted at the end of the base 31. This configuration is intended to achieve the miniaturization and thinning of the device.

Meanwhile, it is considered that UWB antenna devices will be installed in mobile phones, personal computers, keyboards, mice, monitors, and the like for communication with peripheral devices. Therefore, it is desired to make the device thinner and facilitate the mounting and manufacturing of the device.

SUMMARY OF THE INVENTION

The present invention has been made with respect to the above drawbacks and may provide a miniaturized and thinner antenna device which is easily mounted and manufactured, an electronic device, and a method of manufacturing the antenna device.

According to one aspect of the present invention, there is provided an antenna device. The antenna device comprises an element member; a ground member; and an adhesive through which the element member and the ground member are held in a predetermined positional relationship and affixed to a mounting object.

The element member, the ground member, and the adhesive are formed by punching a conductive tape.

The element member and the ground member constitute an ultra-wideband antenna.

The corners of the element member and the ground member are rounded.

According to another aspect of the present invention, there is provided a method of manufacturing an antenna device having an element member and a ground member. The method comprises the step of holding the element member and the ground member in a predetermined positional relationship through an adhesive in such a manner as to cut part of the adhesive of a conductive tape about half-way through, the conductive tape having a conductive foil attached to the adhesive.

An unnecessary part of the adhesive is cut off after the element member and the ground member are affixed to a mounting object, so as to mount the element member and the ground member on the mounting object in the predetermined positional relationship.

The element member and the ground member constitute an ultra-wideband antenna.

The corners of the element member and the ground member are rounded.

According to the present invention, the adhesive for affixing the element member and the ground member to the mounting object holds the element member and the ground member held at a predetermined relationship. Therefore, even if the element member and the ground member are arranged separated from each other in the antenna device, they can be mounted on the mounting object while holding their positional relationship, thereby facilitating the mounting of the antenna device.

DETAILED DESCRIPTION OF THE PREFERRED EMBODIMENT

[Antenna Device 100]

Figure 1:
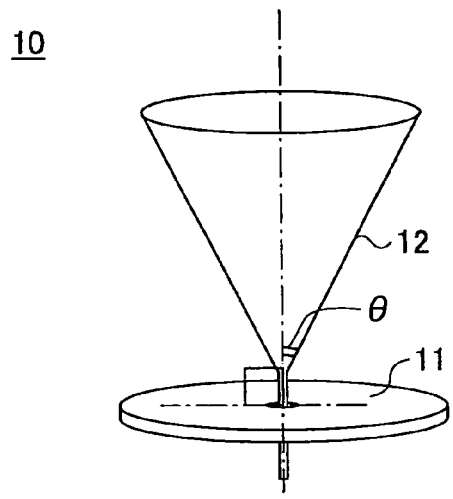
PRIOR ART FIG.1
FIGS. 1A and 1B show block diagrams, each showing an example of a typical antenna device.
Figure 1:
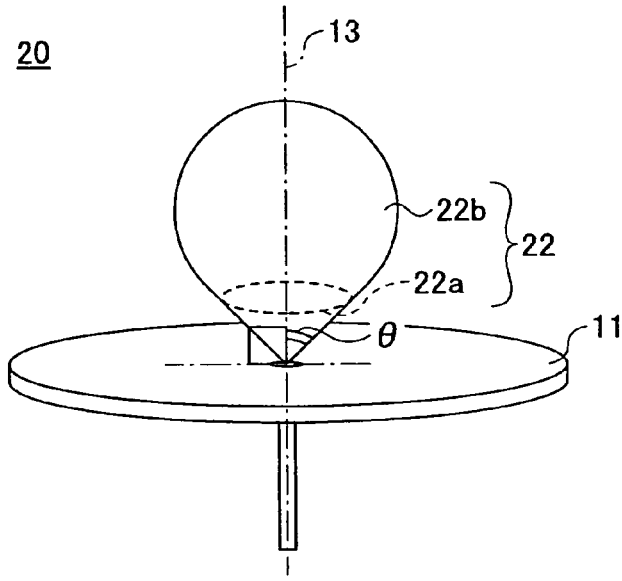
PRIOR ART FIG.1
Figure 2:
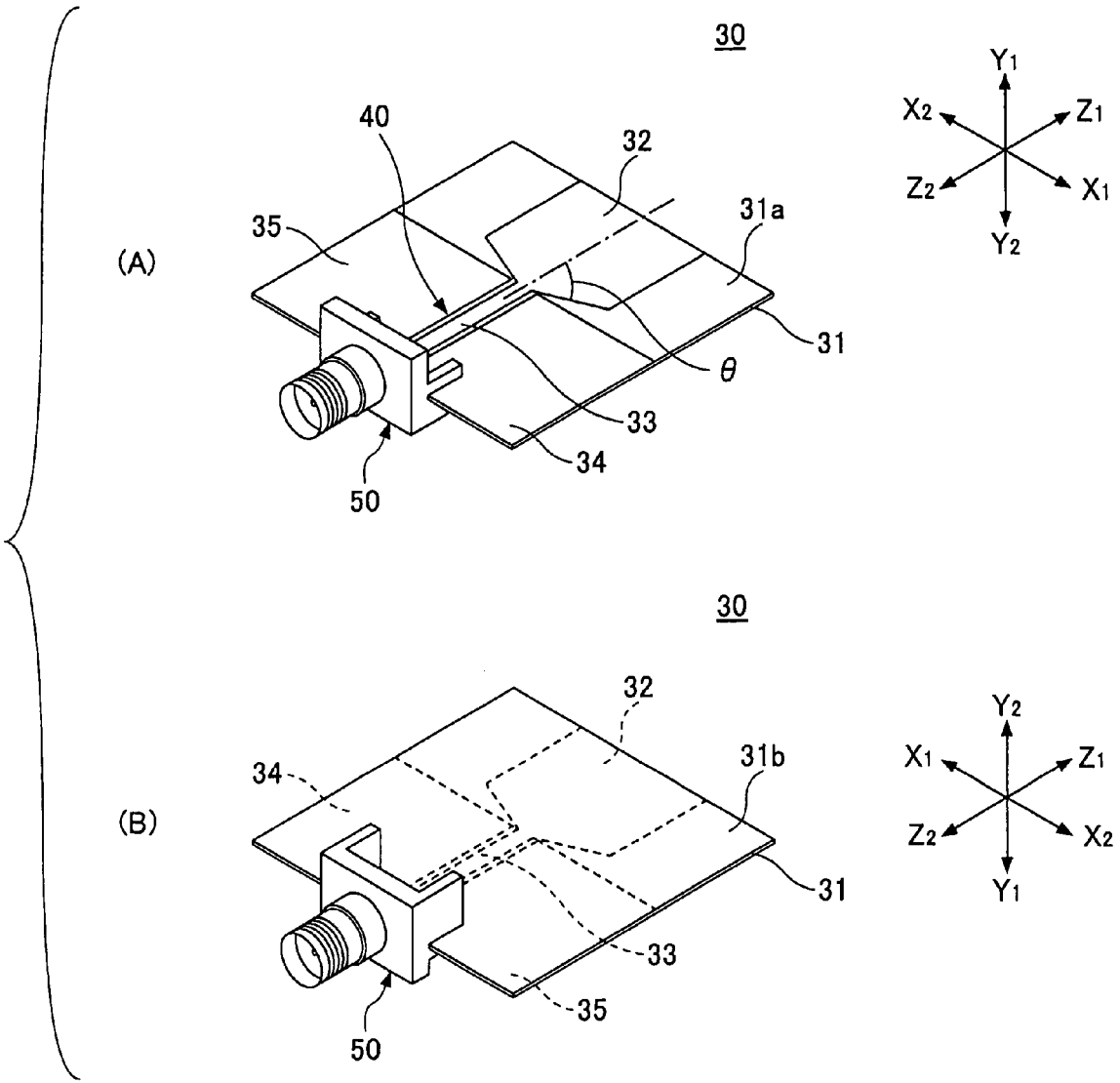
FIGS. 2A and 2B show block diagrams, each showing the UWB flat antenna device that the present applicant previously invented.
Figure 3:
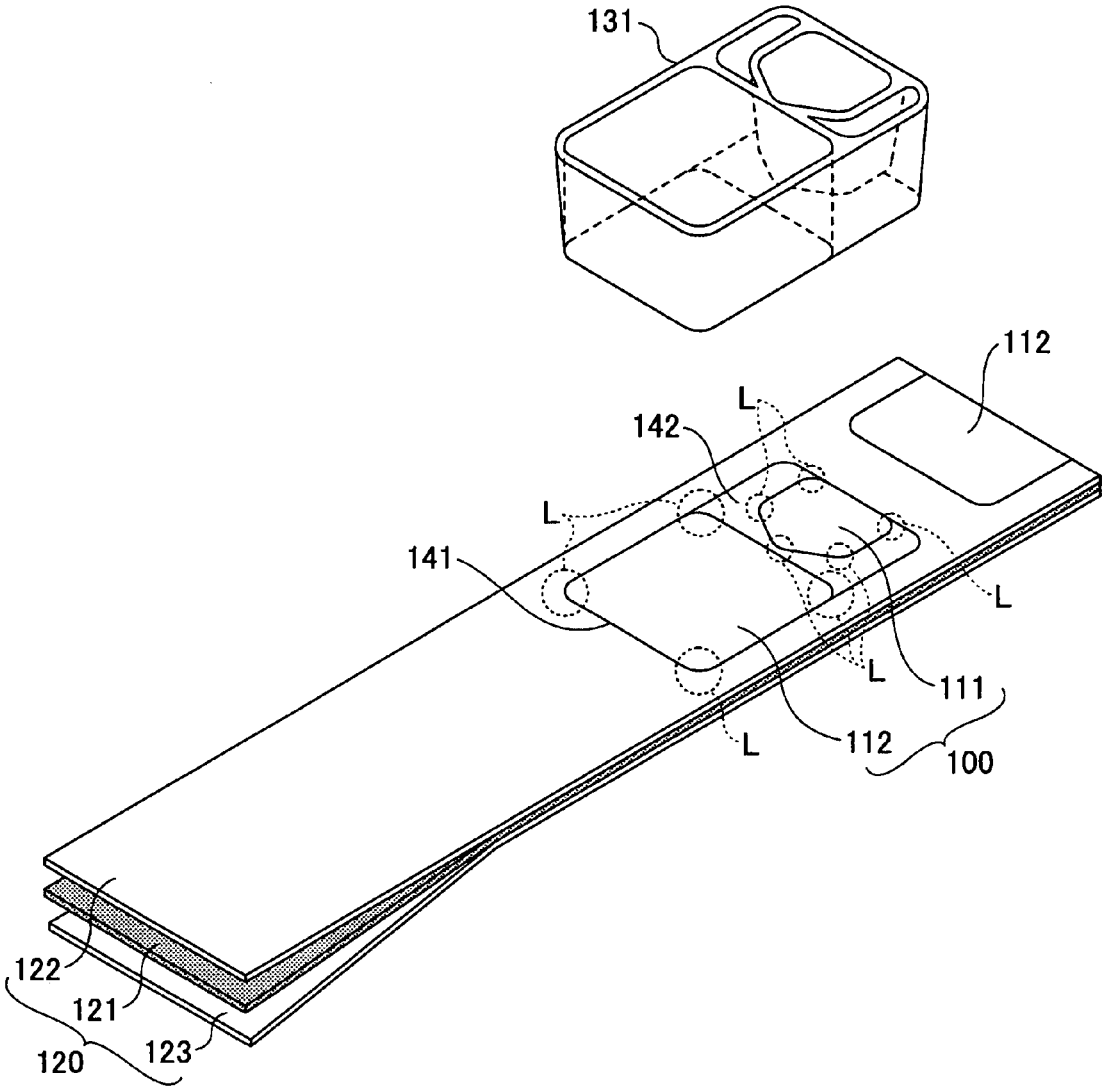
FIG. 3 shows a perspective view of an embodiment of the present invention.

FIG. 3 shows a perspective view of an embodiment of the present invention.

The antenna device 100 of the present embodiment is composed of an element pattern unit 111 and a ground pattern unit 112. The antenna device 100 is formed by punching with a cutting mold 131 a conductive tape 120 having an adhesive 121 one surface of which is affixed with a conductive foil 122 such as a copper foil or an aluminum foil and the other surface of which is affixed with a release paper 123. The conductive tape 120 is punched in such a manner as to cut about half-way through the release paper 123 at a line periphery 141 of the antenna device 100 and the adhesive 121 at a connection unit 142 which connects the element pattern unit 111 and the ground pattern unit 112.

Figure 4:
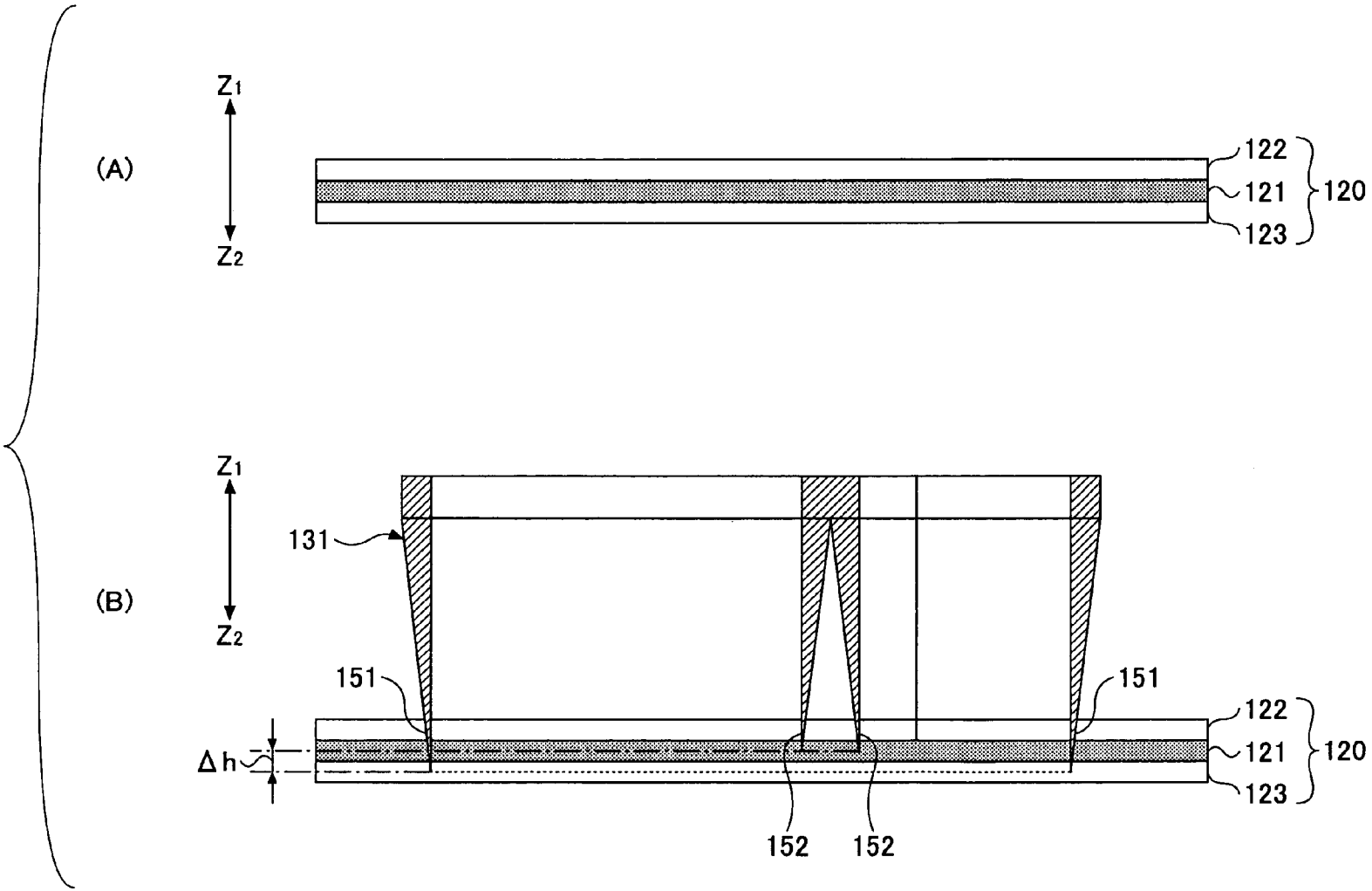
FIGS. 4A and 4B show schematic diagrams of an embodiment of the present invention.

FIGS. 4A and 4B show parts of an embodiment of the present invention. FIGS. 4A and 4B show a schematic diagram of the conductive tape 120 and a schematic diagram at cutting with the mold 131, respectively.

The conductive tape 120 is composed of the conductive foil 122 such as a copper foil or an aluminum foil at one surface of the conductive tape 120 and the release paper 123 at the other surface.

The mold 131 is composed of a cutting part 151 for cutting the line periphery 141 and a cutting part 152 for cutting the connection unit 142.

The cutting part 151 is formed to line up with the boundaries between the element pattern unit 111, the ground pattern unit 112, and the connection unit 142 and their peripheries. The tip end of the cutting part 151 is formed to protrude more in the arrow $Z_2$ direction by $\Delta h$ than that of the cutting part 152 and fully cuts the adhesive 121 and the conductive foil 122 and cuts about half-way through the release paper 123.

Note that the cutting part 151 may be so arranged as to fully cut the release paper 123 besides the adhesive 121 and the conductive foil 122 at the line periphery 141.

The cutting part 152 is formed to line up with the boundary between the element pattern unit 111 and the connection unit 142 and that between the ground pattern unit 112 and the connection unit 142. The tip end of the cutting part 152 is formed to protrude less in the arrow $Z_2$ direction by $\Delta h$ than that of the cutting part 152 and fully cuts the conductive foil 122 and cuts about half-way through the adhesive 121. Note that the cutting part 152 does not protrude down to the release paper 123.

By punching the conductive tape 120 with the mold 131 of the above structure, it is possible to cut the adhesive 121 through which the element pattern unit 111, the ground pattern unit 112, and the connection unit 142 are linked to one another and the conductive foil 122 from the conductive tape 120.

Note that the corners L of the element pattern unit 111 and the ground pattern unit 112 are rounded. Preferably, the curvature radius R of the rounded corners is, for example, about 0.1 mm or more. With the corners of the element pattern unit 111 and the ground pattern unit 112 being rounded, the corners of the molds 131 can be rounded. Since the corners of the molds 131 to which stress is applied can be made thick, for example, it is possible to lengthen the service life of the mold 131.

FIGS. 5 through 8 show drawings for describing a method of mounting the antenna device 100.

Figure 5:
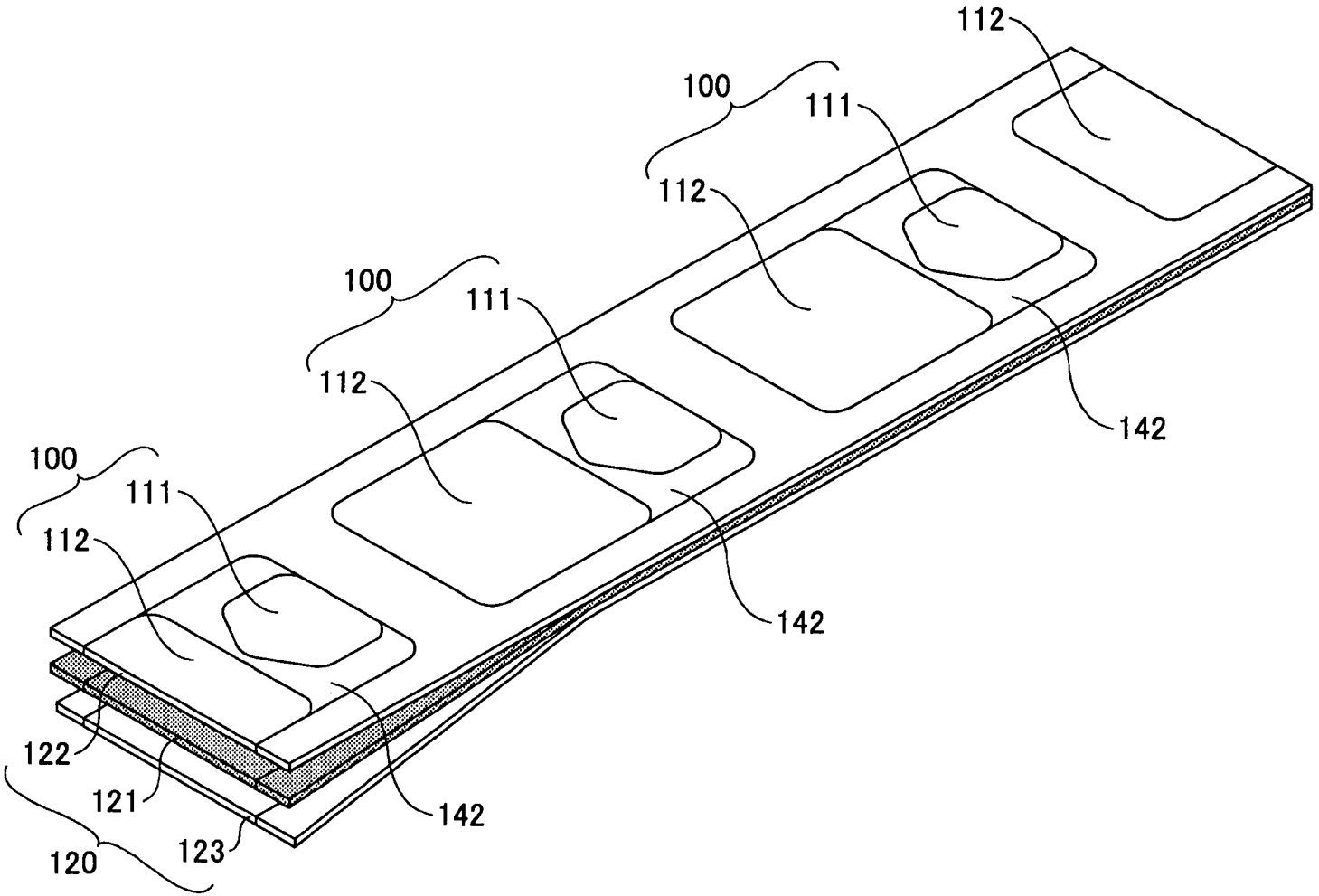
FIG. 5 shows a drawing for describing a method of mounting the antenna device 100.
Figure 6:
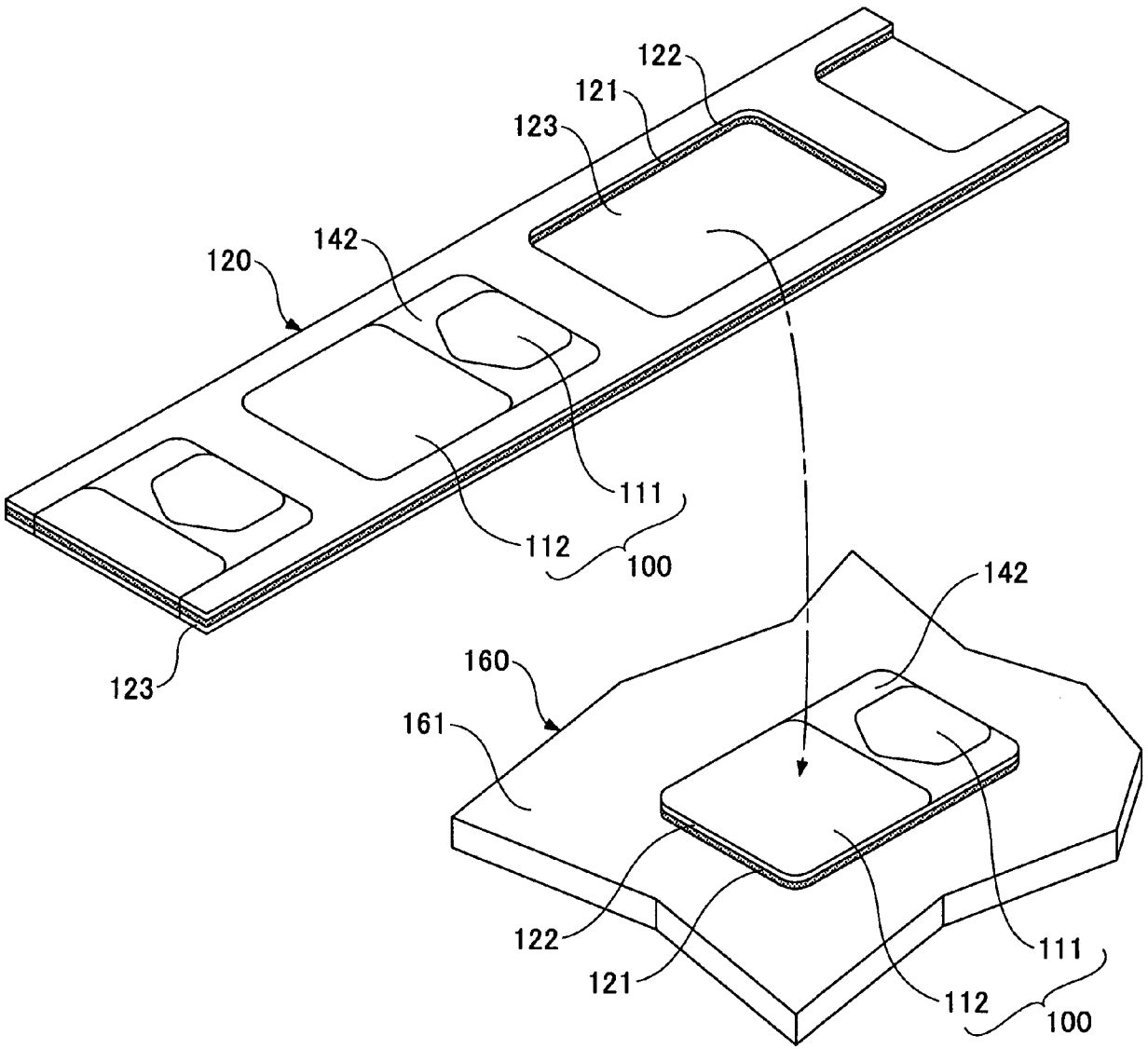
FIG. 6 shows a drawing for describing a method of mounting the antenna device 100.

As shown in FIG. 6, the element pattern unit 111, the ground pattern unit 112, and the connection unit 142, which are linked to one another through the adhesive 121, are released from the release paper 123 of the conductive tape 120 having cut lines formed by the mold 131 as shown in FIG. 5.

On this occasion, the element pattern unit 111 and the ground pattern unit 112 are mutually held at predetermined positions and integrally linked to each other through the adhesive 121 and the connection unit 142.

As shown in FIG. 6, the element pattern unit 111, the ground pattern unit 112, and the connection unit 142, which are released from the release paper 123 of the conductive tape 120 together with the adhesive 121, are affixed to a mounting surface 161 of a mounting object 160.

The mounting object 160 refers to information processing devices, mobile terminal devices, and the peripheral devices thereof, such as mobile phones, personal computers, monitors, keyboards, and mice. The mounting surface 161 refers to the front or rear surface of a casing, a printed-wiring board, or the like.

The element pattern unit 111 and the ground pattern unit 112 are bonded to the mounting surface 161 of the mounting object 160 under pressure to be securely affixed to the mounting surface 161. On this occasion, it is preferable that the connection unit 142 come lightly into contact with the mounting surface 161 so that it can easily be released.

Figure 7:
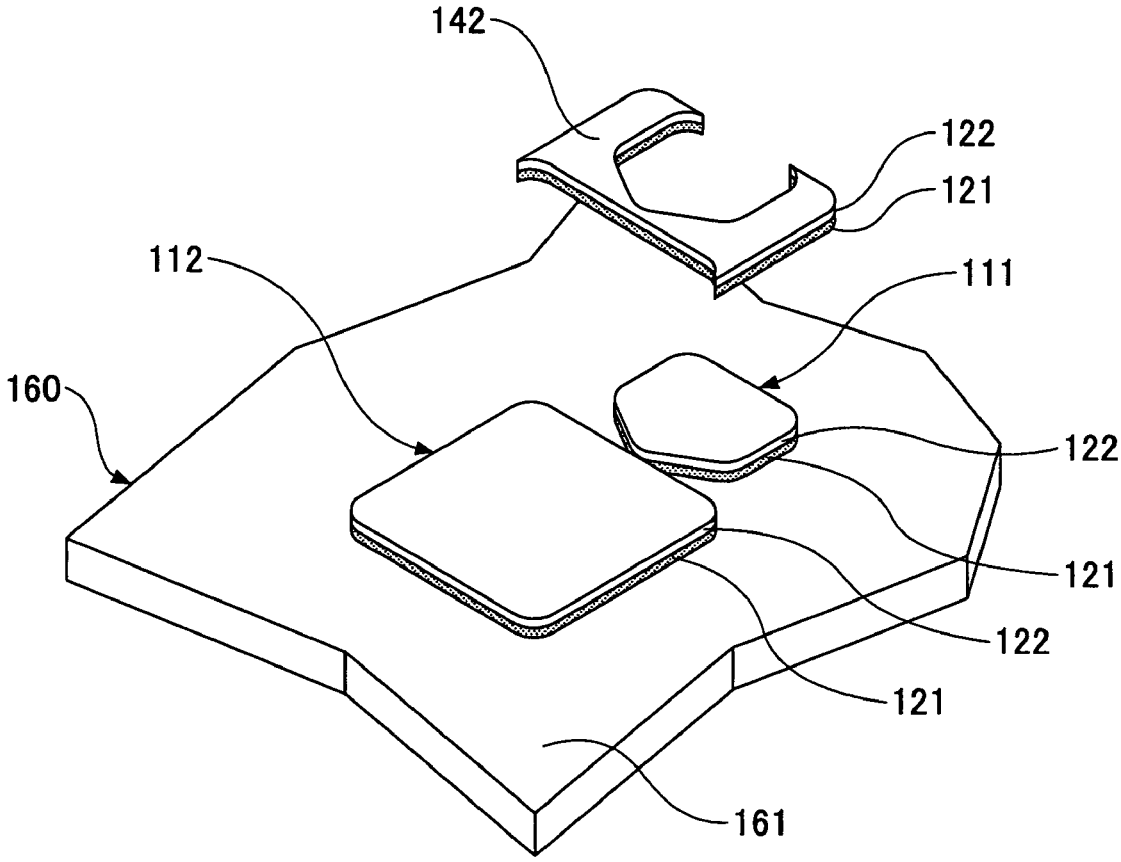
FIG. 7 shows a drawing for describing a method of mounting the antenna device 100.

Next, only the connection unit 142, which connects the element pattern unit 111 and the ground pattern unit 112, is removed from the mounting surface 161 as shown in FIG. 7. On this occasion, since the boundary between the element pattern unit 111 and the connection unit 142 and that between the ground pattern unit 112 and the connection unit 142 are cut about half-way through, the adhesive 121 can easily be removed from the element pattern unit 111 and the ground pattern unit 112.

Figure 8:
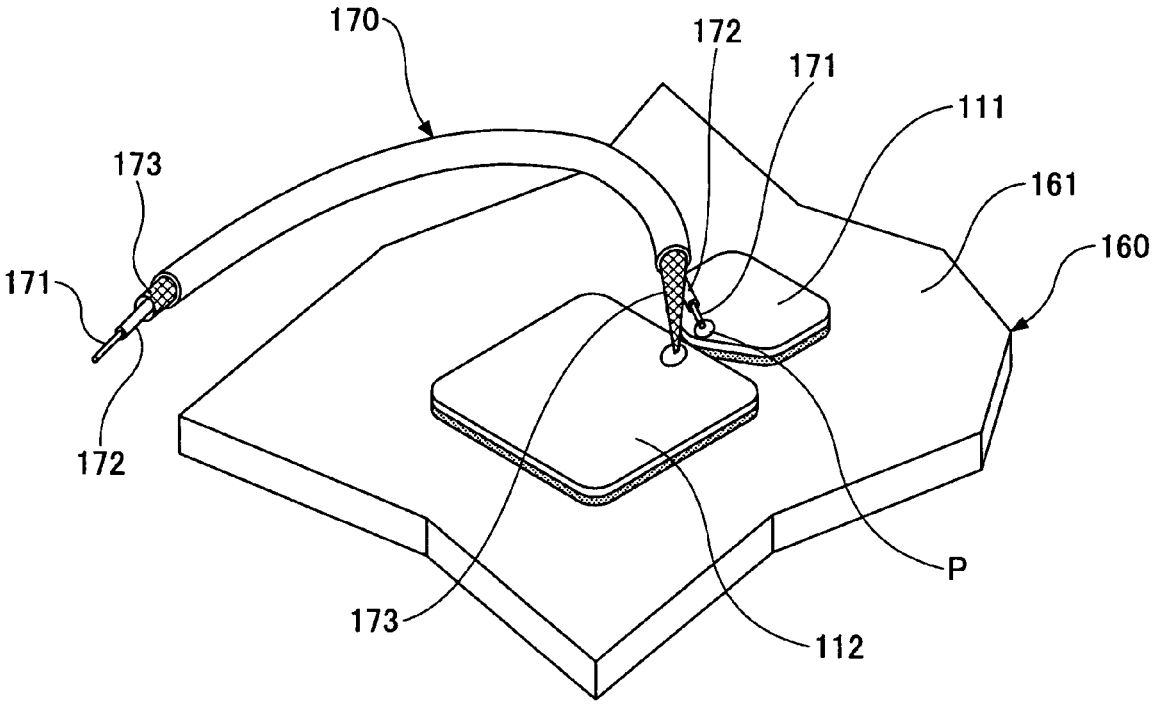
FIG. 8 shows a drawing for describing a method of mounting the antenna device 100.

Then, a coaxial cable 170 is connected to the element pattern unit 111 and the ground pattern unit 112 as shown in FIG. 8. The coaxial cable 170 is composed of a signal wire 172 covered with insulation material 171 and a shielding wire 173 wound around the insulation material 171. The signal wire 171 and the shielding wire 173 are connected by soldering to the power supply point "p" and the ground pattern unit 112, respectively.

Note that there are employed such methods as soldering and pressure bonding to establish a connection between the signal wire 171 and the element pattern unit 111 and between the shielding wire 173 and the ground pattern unit 112. Furthermore, the present embodiment describes an example of directly connecting the coaxial cable 170 to the element pattern unit 111 and the ground pattern unit 112 by soldering or pressure bonding. Alternatively, the coaxial cable 170 may be connected to the element pattern unit 111 and the ground pattern unit 112 in the following manner. Specifically, a socket connector is soldered to the element pattern unit 111 and the ground pattern unit 112, and a plug connector is attached to one end of the coaxial cable 170. With this configuration, the plug connector is inserted in the socket connector to thereby establish the connection between the coaxial cable 170 and the element pattern unit 111 and the ground pattern unit 112.

In a case where a conductive tape having a conductive adhesive is used, it is also possible to connect the coaxial cable 170 to the antenna device 100 by inserting the signal wire 172 between the mounting object 160 on which the antenna device 100 is mounted and the power supply point "p" of the element pattern unit 111 so as to bond the element pattern unit 111 to the mounting object 160 under pressure, and by inserting the shielding wire 173 between the mounting object 160 on which the antenna device 100 is mounted and the ground pattern unit 112 so as to bond the ground pattern unit 112 to the mounting object 160 under pressure.

In a case where the antenna device 100 is affixed to a substrate having a high frequency circuit, pads of a connection pattern are previously formed at places on a printed-wiring board corresponding to and facing the power supply point "p" and the ground pattern unit 112 of the antenna device 100. Accordingly, the antenna device 100 is just affixed to a predetermined position on the printed-wiring board, to thereby connect the power supply point "p" and the ground pattern unit 112 of the antenna device 100 to corresponding pads of the printed-wiring board through the conductive adhesive without soldering or the attachment of the connectors. As a result, it is possible to connect the antenna device 100 and the high frequency circuit to each other.

According to the embodiment of the present invention, the adhesive 121 for affixing the element pattern unit 111 and the ground pattern unit 112 to the mounting object 160 makes the element pattern unit 111 and the ground pattern unit 112 be held in a predetermined relationship. Therefore, even if the element pattern unit 111 and the ground pattern unit 112 are arranged separated from each other in the antenna device 100, they can be mounted on the mounting object 160 while holding their positional relationship, thereby facilitating the mounting of the antenna device 100.

Forming the antenna device 100 by punching the conductive tape 120 makes it possible to make the antenna device 100 thin. Furthermore, the adhesive 121 attaches the antenna device 100 to the mounting object 160, to thereby facilitate the mounting of the antenna device 100. Moreover, the element pattern unit 111 and the ground pattern unit 112 can be mounted on the mounting object 160 while holding their positional relationship, to thereby securely provide the characteristics of the antenna device 100 as designed.

The present invention is not limited to the specifically disclosed embodiment, and variations and modifications may be made without departing from the scope of the present invention.

The present application is based on Japanese Priority Application No. 2007-006198 filed on Jan. 15, 2007, with the Japanese Patent Office, the entire contents of which are hereby incorporated by reference.

What is claimed is:

1. An antenna device, comprising:

an element member;

a ground member; and an adhesive through which the element member and the ground member are held in a predetermined positional relationship and affixed to a mounting object, and wherein corners of the element member and the ground member are rounded.

2. The antenna device according to claim 1, wherein the element member, the ground member, and the adhesive are formed by punching a conductive tape.

3. The antenna device according to claim 1, wherein the element member and the ground member constitute an ultra-wideband antenna.

4. An electronic device having the antenna device according to claim 1 affixed thereon.

5. A method of manufacturing an antenna device having an element member and a ground member, the method comprising:

holding the element member and the ground member in a predetermined positional relationship through an adhesive in such a manner as to cut part of the adhesive of a conductive tape about half-way through, the conductive tape having a conductive foil attached to the adhesive; and rounding corners of the element member and the ground member.

6. The method according to claim 5, further comprising:

cutting off an unnecessary part of the adhesive after the element member and the ground member are affixed to a mounting object, so as to mount the element member and the ground member on the mounting object in the predetermined positional relationship.

7. The method according to claim 5, further comprising:

constituting an ultra-wideband antenna with the element member and the ground member.

* * * * *